United States Patent [19]

Kroebig et al.

[11] B 4,000,776

[45] Jan. 4, 1977

[54] HEAT PIPE SYSTEM

[75] Inventors: Helmut L. Kroebig, Rolling Hills; Frank J. Riha, III, Los Angeles, both of Calif.

[73] Assignee: The United States of America as represented by the Secretary of the Air Force, Washington, D.C.

[22] Filed: Dec. 3, 1974

[21] Appl. No.: 529,194

[44] Published under the second Trial Voluntary Protest Program on March 23, 1976 as document No. B 529,194.

[52] U.S. Cl. ..... 165/32; 165/105; 244/1 R

[51] Int. Cl.[2] ..... F28D 15/00

[58] Field of Search ..... 165/105, 32; 244/1 SS

[56] References Cited

UNITED STATES PATENTS

| | | | |
|---|---|---|---|
| 3,229,755 | 1/1966 | Komarow | 165/32 |
| 3,399,717 | 9/1968 | Cline | 165/32 |
| 3,414,050 | 12/1968 | Anand | 165/105 X |
| 3,519,067 | 7/1970 | Schmidt | 165/32 |

*Primary Examiner*—Albert W. Davis, Jr.
*Attorney, Agent, or Firm*—Joseph E. Rusz; Richard J. Killoren

[57] ABSTRACT

A heat pipe having one wall formed by the component to be cooled and the other wall formed by a cover plate which is a portion of the missile skin, wherein the component wall normally forms the evaporator section and the other wall normally forms the condensing section, has a conventional wire mesh wick connected between the condensing section and the evaporator section. A support plate is attached to the wick adjacent the cover plate. A bellows is connected between the cover plate and support plate to move the cover plate and wick against a spring and away from the cover plate if the skin temperature becomes excessive.

2 Claims, 1 Drawing Figure

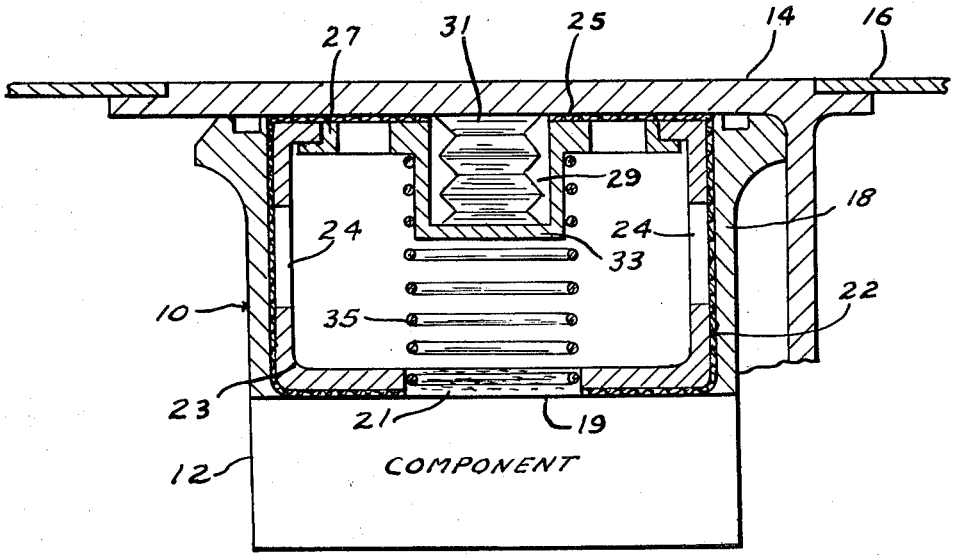
27
31
25
14
16
29
18
24
24
33
22
10
35
23
21
19
12
COMPONENT

HEAT PIPE SYSTEM

RIGHTS OF THE GOVERNMENT

The invention described herein may be manufactured and used by or for the Government of the United States for all governmental purposes without the payment of any royalty.

BACKGROUND OF THE INVENTION

This invention is related to a device which transfers heat from a component, such as a Vuilleunier refrigerator crankcase, to the skin of a missile which limits the reverse flow of heat when excessive skin temperatures are encountered during flight.

Heat pipes are sometimes used to reject heat from components within a missile where heat rejection problems exist. The patent to Cline, U.S. Pat. No. 3,399,717, shows one device wherein a heat pipe is used to transfer heat from a component within the missile to a heat sink wall.

When excessive skin temperatures are encountered during flight, a heat pipe which is originally designed to reject heat from a component will reverse and heat will be transferred into the component.

BRIEF SUMMARY OF THE INVENTION

According to this invention, a heat pipe is provided for transferring heat from a component to the missile skin. The heat pipe has a work fluid, such as water, which is evaporated with an increase in the temperature of the component. The vapor then travels to the missile skin where it condenses. The liquid is then returned to the evaporator section of the heat pipe through a wick in the usual manner. The wick is attached to a retainer which is moved away from the missile wall by bellows which expands when the missile skin is at a high temperature. When the wick and retainer are moved away from the missile wall, the heat pipe no longer has an effective evaporator in the reverse direction and ceases to operate.

IN THE DRAWING

The single FIGURE shows a view partially in section of a heat pipe system according to the invention.

DETAILED DESCRIPTION OF THE INVENTION

Reference is now made to the drawing which shows a heat pipe 10 connected between a component 12, that is the source of heat which is to be transferred, and the cover 14 which forms part of the missile skin 16. The heat pipe body member 18 is connected to the component 12 which has a wall that forms the evaporator system 19 for the heat pipe. A liquid 21, such as water, is used as the working fluid. A wick 22, of a material such as a fine wire stainless steel mesh screen or fiberglass, extends from the evaporator section 19 to the heat pipe cover 14. A wick retainer 23 holds the wick firmly against the heat pipe wall. The wick retainer has holes 24 which aid in the flow of steam from the evaporator to the condenser. The wick 22 has a portion 25 secured to a support plate 27.

The support plate 27 has a chamber 29 inclosing a bellows 31. The bellows 31 is sealed to the heat pipe cover 14 and to the wall 33 of the support plate. The bellows may contain a gas such as air or, for some applications, may contain a heat expandable liquid. The wick 22 is normally held in contact with the heat pipe cover 14 by means of a spring 35 which acts against the support plate 27.

In the operation of the device, the component wall acts as the evaporator and the heat pipe cover, which forms part of the missile skin, acts as the condenser. As the component temperature increases, it causes an evaporation of the working fluid which flows to the missile skin where it condenses giving up its latent heat. The condensate is returned to the evaporator through the wick by capillary action.

When the missile skin is heated to an excessive temperature, the evaporator and condenser sections of the heat pipe reverse and heat would normally be transferred to the component at time when the wall is cool enough to condense the liquid. However, heating of the material within the bellows causes the bellows to expand moving the support plate 27 and wick 22 away from heat pipe cover 14, thus effectively eliminating the evaporator for the reverse heat flow system which substantially reduces the heat flow into the component from the missile skin through the heat pipe.

There is thus provided a heat pipe system which effectively acts as a heat pipe diode.

We claim:

1. A heat pipe diode device for transferring heat from a heat source component to a heat sink wall comprising: a heat pipe body member attached to said component; said component having a wall forming at least a portion of the normal evaporator section of the heat pipe diode device; a working fluid within said body member; a cover for said heat pipe diode device forming at least a portion of the said heat sink wall; said cover forming the normal condenser for said heat pipe diode device; a wick connected between the condenser and the evaporator of said heat pipe diode device; means for retaining the wick adjacent the heat pipe wall; a wick support plate adjacent said cover; said wick being attached to said support plate; means for holding said wick in contact with said cover; means, responsive to excessive temperatures at said heat sink wall, for moving said support plate and a portion of said wick away from said cover to thereby substantially reduce heat flow in the reverse direction through said heat pipe diode device.

2. The device as recited in claim 1 wherein said means for moving said wick and support plate away from said cover being a bellows having one end sealed to said support plate and the other end sealed to said cover; means, in said bellows, for expanding the bellows in response to an increased temperature at said heat sink wall.

* * * * *